US007731609B2

(12) United States Patent
Wiens et al.

(10) Patent No.: US 7,731,609 B2
(45) Date of Patent: Jun. 8, 2010

(54) GOLF GREEN REPAIR DEVICE METHOD AND APPARATUS

(75) Inventors: Terry G. Wiens, Langley (CA); Richard D. Edwards, Scottsdale, AZ (US)

(73) Assignee: Greenfix Golf, Inc., Scottsdale, AZ (US)

( * ) Notice: Subject to any disclaimer, the term of this patent is extended or adjusted under 35 U.S.C. 154(b) by 274 days.

(21) Appl. No.: 11/740,191

(22) Filed: Apr. 25, 2007

(65) Prior Publication Data

US 2008/0268985 A1 Oct. 30, 2008

(51) Int. Cl.
*A63B 57/00* (2006.01)

(52) U.S. Cl. ..... 473/408

(58) Field of Classification Search ..... 473/408, 473/286, 409; D21/793
See application file for complete search history.

(56) References Cited

U.S. PATENT DOCUMENTS

| | | | | |
|---|---|---|---|---|
| 3,049,182 | A * | 8/1962 | Pelow | 473/408 |
| 3,185,483 | A | 5/1965 | Klynman | |
| 3,456,737 | A | 7/1969 | Rhyme | |
| 4,315,624 | A | 2/1982 | Buckman | |
| 4,951,951 | A | 8/1990 | Meyer | |
| 5,209,469 | A | 5/1993 | Laskowitz et al. | |
| 6,095,935 | A | 8/2000 | Gooselaw et al. | |
| D436,152 | S | 1/2001 | Sanford | |
| 6,217,465 | B1 * | 4/2001 | Kenia, Jr. | 473/408 |
| 6,223,829 | B1 * | 5/2001 | Wiens | 473/408 |
| 6,224,502 | B1 | 5/2001 | Warfield | |
| D452,544 | S | 12/2001 | Bato | |
| 6,546,981 | B2 | 4/2003 | Cameron | |
| 6,565,458 | B1 | 5/2003 | Cameron | |
| 6,733,402 | B2 * | 5/2004 | Christensen | 473/408 |
| D493,859 | S | 8/2004 | Lee | |
| D526,378 | S * | 8/2006 | Blanks | D21/793 |
| 2002/0007955 | A1 * | 1/2002 | Wiens | 473/408 |
| 2002/0055401 | A1 | 5/2002 | Caldwell | |
| 2007/0093322 | A1 * | 4/2007 | Blanks | 473/408 |
| 2007/0111826 | A1 * | 5/2007 | Blanks | 473/408 |
| 2007/0202967 | A9 * | 8/2007 | Blanks | 473/408 |

* cited by examiner

*Primary Examiner*—Steven Wong
(74) *Attorney, Agent, or Firm*—Dwayne E. Rogge; Hughes Law Firm, PLLC

(57) ABSTRACT

A golf green repair tool with a depth limiting feature that has an earth engagement surface that has a forward slant to reposition the raised portion around a crater to the center region of the crater. A prong portion is adapted to be thrusted toward the center region of the crater and the repair tool is adapted to do minimal damage to the turf mat and provides a desirable method to repair craters left by impacting golf balls by properly repositioning of the displaced portions.

5 Claims, 10 Drawing Sheets

GOLF GREEN REPAIR DEVICE METHOD AND APPARATUS

RELATED APPLICATIONS

This application claims priority benefit of U.S. Ser. No. 60/560,324, filed Apr. 6, 2004 and Ser. No. 11/101,023 filed on Apr. 6, 2005 now U.S. Pat. No. 7,238,126.

BACKGROUND OF THE INVENTION

In the sport of golf, greens are generally comprised of a sand and peat moss composition that is well-suited for an upper plane surface comprised of turf plant that is cut to a low height. This upper plane surface provides a relatively low resistance rolling surface for a golf ball and the gradient of the surface is very gradual so there are a minimal number of localized dips and edges that divert a golf ball in its course of travel during a putt. However, on occasion craters or ball marks are created in the green and the most common form of creating a crater is when a golf ball forcefully lands upon a green and causes a ball mark crater thereupon. Often times, a chip shot is taken with a higher numbered iron whereby the ball has a forward and downward arcing trajectory upon impact. Normally, the forward path of the golf ball creates a raised region in the forward direction. It is normal protocol and a courteous procedure to repair the craters and ball marks after they are created.

Prior art methods of repairing the green after a dent is created comprise two-dimensional tools with extension members adapted to extend into the turf layers and the underlying ground layer immediately therebelow, whereby the prior art lacks a depth limiting feature and a forward surface to manipulate the upper sod layer.

The tool as shown in U.S. Pat. No. 6,223,829 shows a method and apparatus to repair dents in a green formed by golf balls. The apparatus is adapted to be positioned onto the upper handle region of the golf putter or the like. It has been found that having a maneuverable apparatus with a handle region and a rearward surface to aid in the manipulation of the golf green is advantageous for fixing a dent thereon.

Tilting and leveraging of the underground and above ground roots, rhizomes and stolons actually kills the grass, but pushing it forward does not. In essence, the teaching of a retrofit to a putter is to have a flat upper surface such that when your putter is in a stored position in a golf bag, the entire surface is resting on the very bottom portion of the floor of the golf bag.

SUMMARY OF THE DISCLOSURE

A golf green repair tool having a handle region comprising forward and rearward portions about a handle longitudinal axis, with an operating region having forward and rearward regions. In the forward region there is a prong portion having extendable prongs centered substantially about an earth engaging axis. There is further a depth limiting feature having an earth engaging surface that is, for example, is forward slanting with respect to the earth engaging axis in one form. Also provided is a thumb engagement region positioned in the rearward region of the prong portion.

DETAILED DESCRIPTION OF THE PREFERRED EMBODIMENTS

Figure 1:
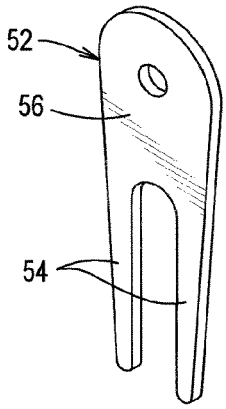
FIG. 1 PRIOR ART
FIGS. 1, 2, 3 and 4 are cross-sectional views taken along a vertical plane parallel to the line of flight of the ball making the dent and extending through the center of the dent in the green, these three views showing in sequence the typical prior art manner of using the "ball mark fixer" in repairing the green.
Figure 2:
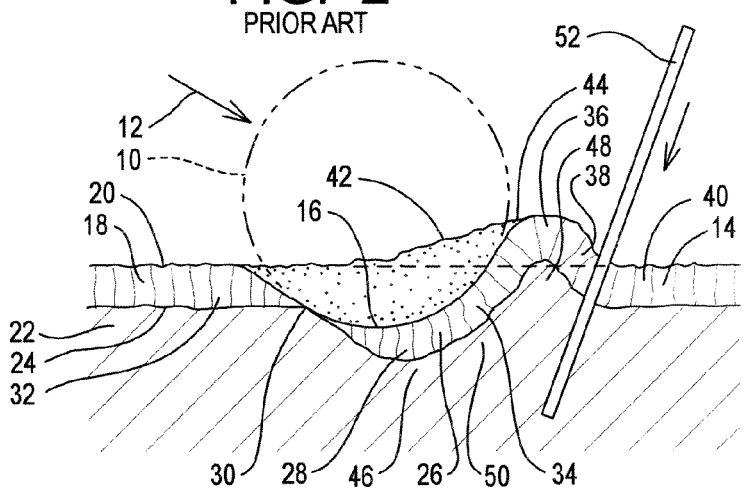
FIG. 2 PRIOR ART

There will first be a description of how a crater or dent is commonly formed in the golf green by a golf ball with reference to FIGS. 1 through 4. With reference to FIG. 2, there is shown in broken lines a golf ball 10 having descended on a downwardly sloping path (indicated by the arrow 12) to engage the golf green 14 and form the dent or indentation 16. For purposes of description, the golf green 14 can be considered to be made up of two layers. First, there is the upper sod layer 18, which is known as a turf mat, that comprises grass and thatch thereunder which is an interweaving of rhizomes and stolons (horizontal roots) that comprise the green putting surface 20. There is an underlying ground layer 22 immediately therebelow the sod layer 18 which generally comprise roots vertically orientated roots. The interface of the sod layer 18 and the ground layer 22 is indicated at 24.

In the following description, the term "forward" will refer to the direction of the horizontal component of the path of the ball as it impacts the green, and the term "rear" or "rearward" will denote the opposite direction. Further the orthogonal direction of the forward and rearward axes and a vertical axis indicates a lateral axis. Thus, in FIG. 2, the term forward refers to a direction extending toward the right and the lateral axis extends directly out from the figure.

As shown in FIG. 2, when the golf ball 10 strikes the green surface 20 as it travels on its downward and forward path (indicated at 12), the sod layer portion 26 immediately below and just forward of the impact location of the golf ball is pushed both downwardly and forwardly (to the right as seen in FIG. 2).

More specifically, there is a rear sod portion 28 that has been pushed downwardly and forwardly, as shown in FIG. 2. This figure further shows the sod portion 28 being severed (or at least partially severed) along a separation line 30 from a further rear portion of sod 32 which is just rear of the location where the location of the ball 10 impacts the green surface 20, and is undisturbed. However, it is to be understood that this pattern of the displacement of the sod layer 18 is not always the same, depending upon the conditions of the green. However, the situation as shown in FIG. 2 is fairly typical. Just forward of the sod portion 28, there is an upwardly and forwardly sloping sod portion 34 that forms an upwardly and forward sloping part of the dent 16, and further forward of the portion 34 there is a raised edge portion 36, which then slopes downwardly and forwardly at 38, joining a yet further forward portion of the green 40 which remains level and undisturbed.

In addition, the impact of the golf ball 10 also displaces the ground material laterally, as indicated at 42, so that the raised sod portion 36 and the edge portion 42 create an edge perimeter portion which shall be designated collectively as 44.

In addition to the sod layer 18 being displaced as described above, the immediate underlying ground layer 22 is also displaced. More specifically, a portion of the ground layer that was immediately below the location where the ball impacts the green is displaced in a manner to create a lower portion 42 just beneath the sod layer portion 28, a raised edge portion 48 which is just beneath the upper sod edge portion 48, and an intermediate portion 50.

Again, it is to be understood that the contours of the dent 16 vary depending upon the path of the ball (whether it is descending in a more vertical slope or more horizontally aligned), the hardness of the underlying ground layer 22, and resistance of the sod layer 18 to being separated and/or compressed, etc.

In FIG. 1, there is shown the prior art "ball mark fixer" 52. It can be seen in FIG. 1 that this has a generally U shaped configuration, comprising two generally parallel arms or tines 54 that form the sides of the U, and a base gripping portion 56 that provides opposite gripping surfaces by which the tool 52 can be grasped in a person's fingers and manipulated.

Figure 3:
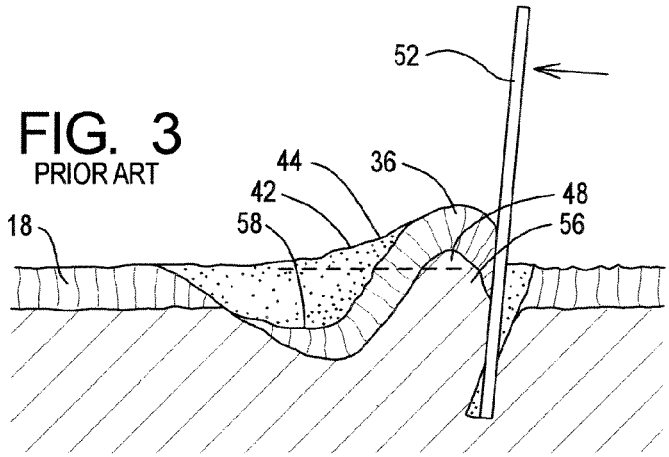
FIG. 3 PRIOR ART
Figure 4:
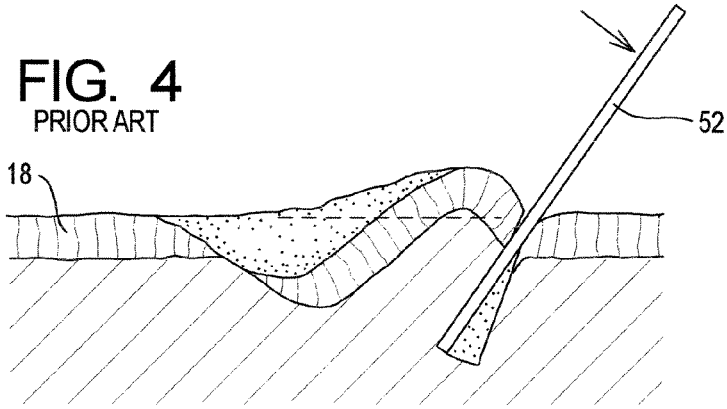
FIG. 4 PRIOR ART
Figure 5:
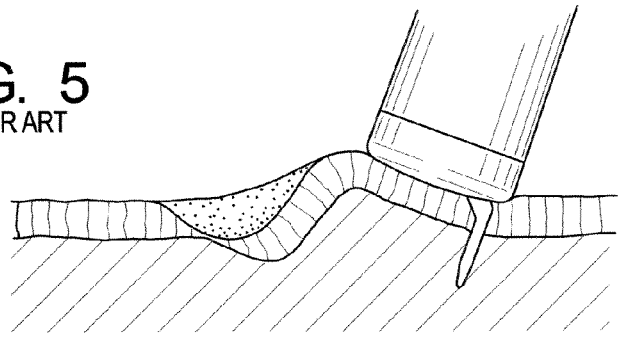
FIG. 5 PRIOR ART
FIG. 5 shows another prior art device.

The manner in which this is used is shown in FIG. 2, where it can be seen that the tool 52 is pushed into the ground around the perimeter edge portion 44 of the dent, and as shown in FIGS. 3 and 4, the tool 52 is manipulated by rotating it about a horizontal axis to displace some of the underlying earth 56 toward the center location 58 of the dent 16. The effect of this is to push the edge portion of the dent forming material, namely the upper edge portion 36 of the sod and the lower portion 48 of the underlying ground layer to the left. After this has been accomplished, the green surface 20 can be flattened to some extent by pressing the head of the club or other surface against the green surface at the location of the dent 16.

As indicated previously, an alternative method of repairing the green is simply to use a golf tee which is stuck into the green surface a number of times around the perimeter of the dent, again prying the earth and the sod forming the raised edge portion around the dent inwardly toward the center 58, and then flattening out the green surface.

Overall, the above method is only partially effective. It does cause an overall displacement in the material forming the sod layer 18 and underlying ground layer 22 toward the dent 16, but it is rather lacking in restoring the green surface to a condition closer to its original form (i.e. where the sod layer is a uniform layer having a reasonably flat upper green surface 20). In addition, because of the deep penetration of the tool and the cutting of the roots, rhizomes and stolons, the turf plant affected dies within a few hours, negating any positive impact from the attempt to repair it with the traditional tool and technique.

Figure 6:
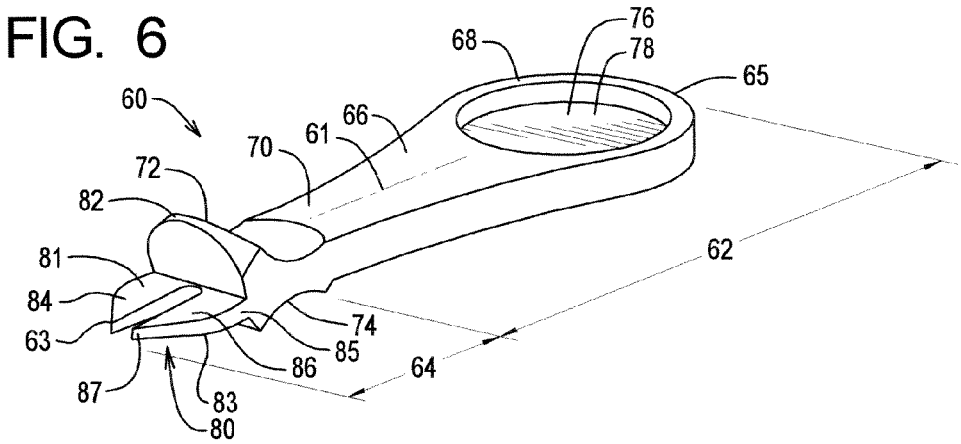
FIG. 6 shows an orthogonal view of a tool that is adapted to fix a crater in a green.

As shown in FIG. 6 there is an example of a prior art device that is adapted to be mounted to the end portion of a putter. This prior art device allows for a certain amount of repositioning of the edge perimeter portion; however, this device is intended to be employed in a situation where the golfer chooses not to bend over but rather engages in a direct thrusting action along the center axis of the putter shaft to repair a crater.

With the foregoing in mind as background information, there will now be a description of the present invention.

There will now be a discussion of the tool 60 with initial reference to FIG. 6. The tool 60 has a longitudinal axis 61, a first end 63 and a second end 65. As shown this figure, the tool comprises a grasping region 62 and an operating region 64. In general, the grasping region 62 comprises a handle 66 having a rearward portion 68 and a forward portion 70. Located in the forward portion is a thumb engagement surface 72 and an index finger engaging surface 74 that is positioned substantially opposite to the thumb engagement surface 72. Located in the rearward portion 68 of the grasping region 62 is a display portion 76 which in one form comprises a recess cavity 78 that is adapted to have an emblem mounted therein. For example, a circular disc like emblem displaying a particular golf club's name and insignia or a golf organization can be mounted therein the recess cavity 78. The ability to retrofit a disc like or other shaped emblem to a recess region 78 eases manufacture where the tool 60 can be mass-produced by process such as plastic injection molding or the like, and a smaller number of tools to be distributed at a particular club can be retrofitted with the club's emblem.

The thumb engagement surface 72 is in one form the rearward portion of the depth limiting feature 82 describe further herein. In general, the thumb engagement surface 72 provides a surface for the user to thrust a tool 60 along the earth engaging axis 100 described below (see FIG. 8). The index finger engaging surface 74 is adapted to assistant grasping the tool 60 and cooperate with the thumb engagement surface 72 so the user can properly handle the tool and thrust it into the turf mat 18 (see FIG. 2). The index finger engaging surface 74 is particularly adapted to provide a normal force to the longitudinal axis 61 of the tool 60 as well as a partial force that is parallel to the earth engaging axis 100 of the tool 60.

Figure 7:
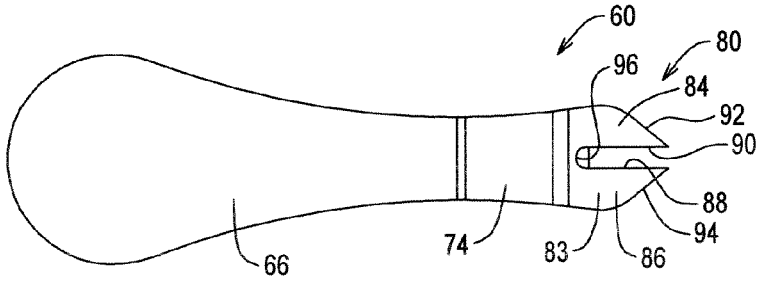
FIG. 7 is the bottom view of the tool.

There will now be a discussion of the operating region 64 continuing to reference FIG. 6. The operating region 64 comprises an earth insert (otherwise referred to as an earth penetrating portion) 80, and a depth limiting feature 82. In one form, the operating region 64 comprises a first prong and a second prong 84 and 86 respectively, comprising a prong portion. Of course more than two prongs can be employed as shown further herein. As shown in FIG. 7 there is a bottom view of the tool 60 where the first and second prongs have interior edges 88 and 90. The first and second prongs 84 and 86 further have exterior edges 92 and 94. It is desirable to have minimal sharp contours on the various interior and exterior surfaces to prevent incising the root structure of the turf mat. In general, the rhizomes and stolons are laterally extending roots about a horizontal plane. It is desirable to not cut these roots but rather have an earth engaging region 80 adapted to have minimal intrusion but utilize the turf mat 18 to provide a lateral force in the direction of the center of the crater as describe further herein. Therefore, it is preferable to have an angle between the interior and exterior surfaces 88 and 92 as well as 90 and 94 that is approximately less than 45° to prevent the lateral separation of the turf mat's rhizomes and stolons. As described further herein, a plurality of prongs can be employed.

As for the embodiment shown in FIG. 7, the earth engaging region 80 further has a base surface 96 which is generally positioned in close proximity to the depth limiting feature 82. The base surface 96 as well as the depth limiting feature 82 essentially limit the depth of insertion of the tool 60 when in use.

As further shown in FIG. 6, the earth engaging region 80 further has an upper surface 81 and a lower surface 83. Of course the upper and lower surfaces 81 and 83 are spread out amongst the various prongs that are employed. In general the upper and lower surfaces 81 and 83 taper slightly from the base region 85 to the tip region 87.

Figure 8:
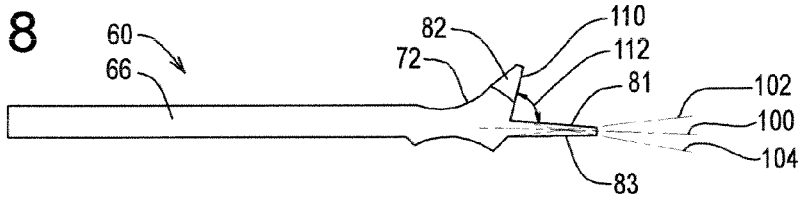
FIG. 8 is a side view of the tool.
Figure 8A:
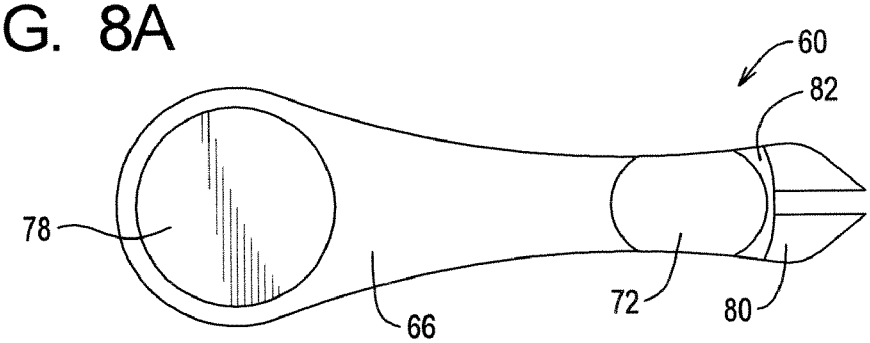
FIG. 8A to the top view of the tool.
Figure 8B:
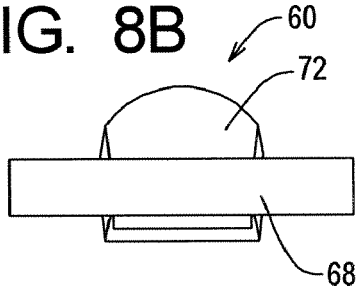
FIG. 8B is the rearward view of the tool.
Figure 8C:
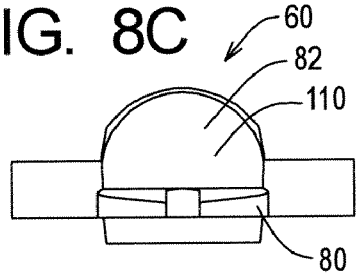
FIG. 8C is a front view of the tool.
Figure 8D:
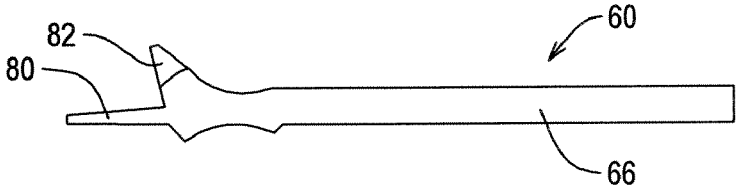
FIG. 8D is another side view of the tool.
Figure 11:
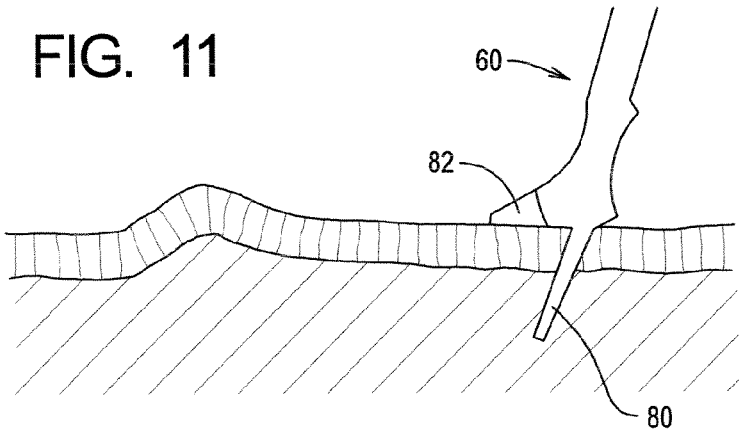

Now referring to FIG. 8, the tool 60 is shown with an earth engaging axis 100. In general, the earth engaging axis is an indication of the orientation of the tool when it is a fully inserted position as shown in FIG. 11 and as discussed below. Of course, the earth engaging axis 100 is a general indicator of the position and depending on the profile of the tip regions of the prongs 84 and 86 the axis may shift from a location such as 102 or 104. As describe further herein the earth engaging region 80 has curved upper and lower surfaces having a different method of defining the earth engaging axis 100.

As further shown in FIG. 8, the depth limiting feature 82 comprises an earth engaging surface 110 that is adapted to bias the upper sod layer 18 in a manner described below. The angle 112 between the mean sod repositioning surface 110 and the earth engaging axis 100 is less than 90° and a preferred range is between 22° and 800 about a laterally extending axis. A more preferred range for the angle 112 is less than 75° and further is between 30° and 55°. As described in detail with reference to the actual use of the tool in FIGS. 9-11, by having the angle 112 less than 90° and more preferably in the ranges described above, the tool acts as a lateral and downward displacing device in a more effective manner than the prior art tools.

Figure 9:
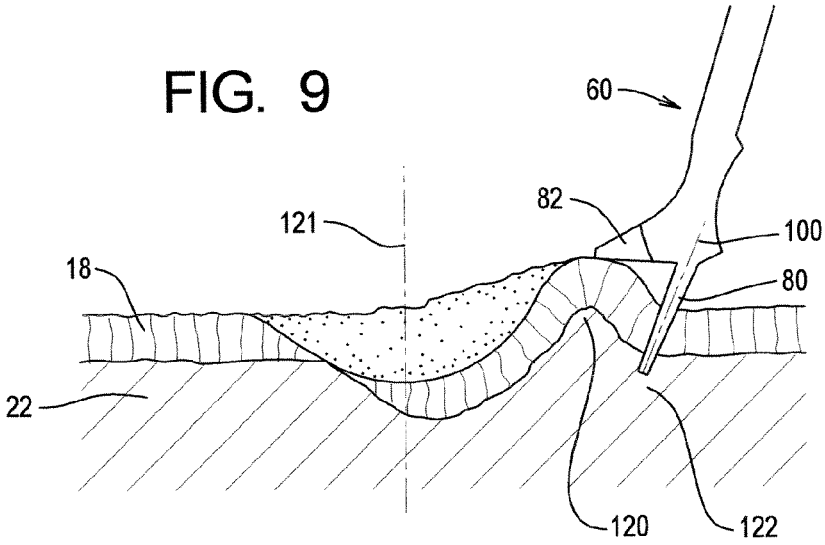
FIG. 9-12 show progressive views of a method of repairing a crater.
Figure 10:
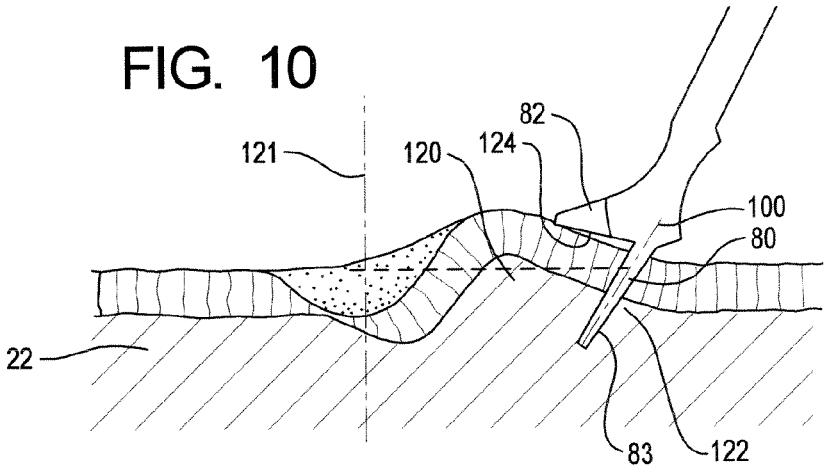

Now referring to FIGS. 9-11, there will be a discussion of the actual use of the tool where as shown in these figures, a crater on a green has occurred and the golfer or golfer's caddy is now attempting to repair the crater. In general, the forward portion of the crater and adjacent lateral portions have the built-up region as described in the beginning of this text. This built-up crater mound region 120 is going to be moved to the center axis of the crater 121. The most desirable result for this movement is to minimize the disturbance to the root structure. Therefore, it has been found that biasing the mound of the crater in the horizontal plane and downwardly has a minimum impact upon the root structure whereby the ground layer 22 is thrusted downwardly and towards the center as well as the sod layer 18. In essence, the sod layer 18 is repositioned but remains substantially intact whereby the ground layer 22 is shifted back to an approximate original location in the central area of the crater.

As shown in FIG. 9, the earth engaging region 80 has just begun to enter the upper portion of the sod layer 18. It is desirable to engage the sod layer 18 at the undisturbed region just outside of the crater mound 120 at an approximate location indicated at 122. The orientation of the tool 60 should be such that the sod repositioning surface 110 is approximately in the horizontal plane or tilted slightly clockwise as shown in FIG. 9.

Figure 12:
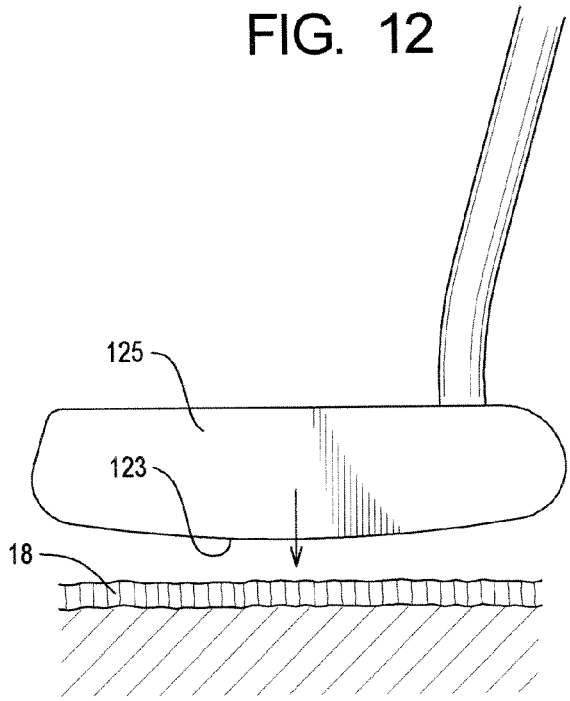

Now referring to FIG. 10, the earth engaging region 80 is partially engaged into the upper sod layer 18 and the forward portion of the mound 124 is beginning to be biased rearwardly and downwardly. In general, the lower surface 83 of the earth engaging region 80 is adapted to reposition the depth limiting feature 82 in the rearward direction as the sod repositioning surface 110 moves downwardly. Now referring to FIG. 11, it can be seen how the sod repositioning surface 110 has repositioned the upper sod layer 18 downwardly and rearwardly. Further, the ground layer 22 is repositioned toward the center axis 121 of the crater region. This process can occur around the various forward and lateral regions of the crater to obtain a very desirable putting surface. In general, the center axis of the indentation is an approximate center region perhaps at the lowest point or center impact portion where the ball has struck. In general, the golf green repair tool 60 is adapted to be generally thrusted towards this center axis 121 as shown in FIGS. 9 and 10. This directional thrusting is defined broadly and generally indicates a repositioning of the perimeter crater mound region 120 to the central voided region about and around the axis 121. Further, the definition of thrusting toward the center axis 121 is not limited to an orthogonal movement to the axis, but rather any tangent motion toward the axis which will generally be a direction below the surface 18 and most likely along the earth-engaging axis 100 as shown in FIGS. 9 and 10. As shown in FIG. 12, the bottom portion 123 of the putter can be used as a planing device to substantially flatten out the localized raised portions of the sod 18.

There will now be a disclosure of various embodiments where similar numerals will be designated with similar components as previous embodiments with an additional alpha numeric character (e.g. 'a', 'b', 'c', etc.) added to the latter portion of the numeric designation.

Figure 13:
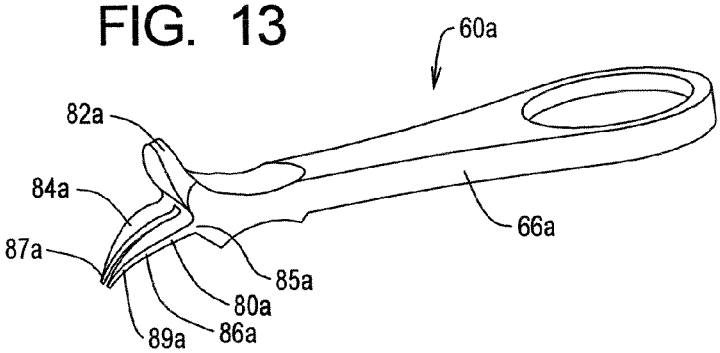
FIG. 13 shows a second embodiment of the tool that is adapted to repair craters.

As shown FIG. 13, the tool **60*a* comprises a handle region 66*a* and an earth engaging region 80*a* as well as a depth limiting feature 82*a*. As shown in this Fig., the earth engaging region has a first prong 84*a* and a second prong 86*a*. The prongs 84*a* and 86*a* have a general slope about the mean axis extending through the substantial center region 89*a* of the prongs downwardly from the base region 85*a* to the tip region 87*a*. In general, the rounded earth engaging region 80*a* can be used for a rolling like effect upon the upper surface of the upper sod layer 18**.

As shown in FIG. **13*a*, the earth engaging axis 100*a* is defined as the base region of the earth engaging region 80*a*. Essentially, the earth engaging axis can fluctuate about the lateral axis toward the first transverse direction and the second transverse direction at approximately ten degrees in either direction and at greater degrees in the broader scope. The axis 100*a* defines the final orientation of the tool 60*a* when it is inserted fully into the green. The earth engaging axis 100*a* generally extends through the center region of the earth engaging region 80*a***.

Figure 14:
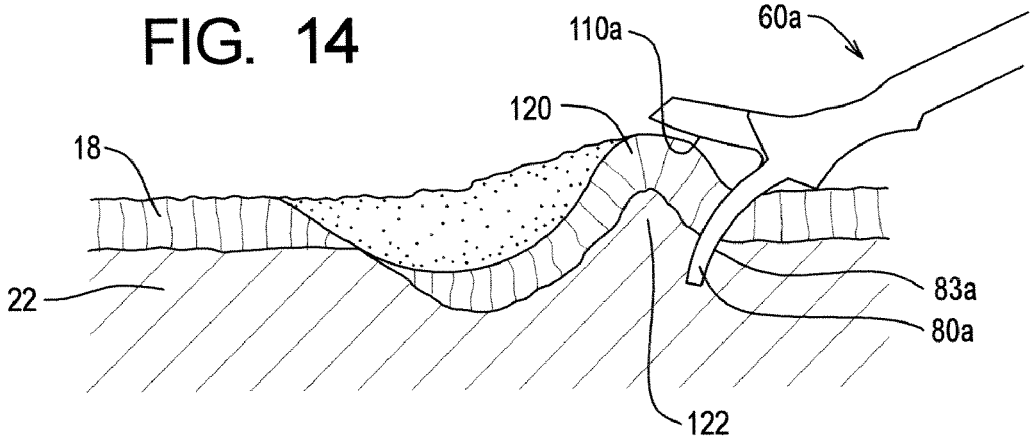
FIGS. 14-16 are progressive views showing a method of repairing a crater with the tool that is shown in FIG. 13.
Figure 15:
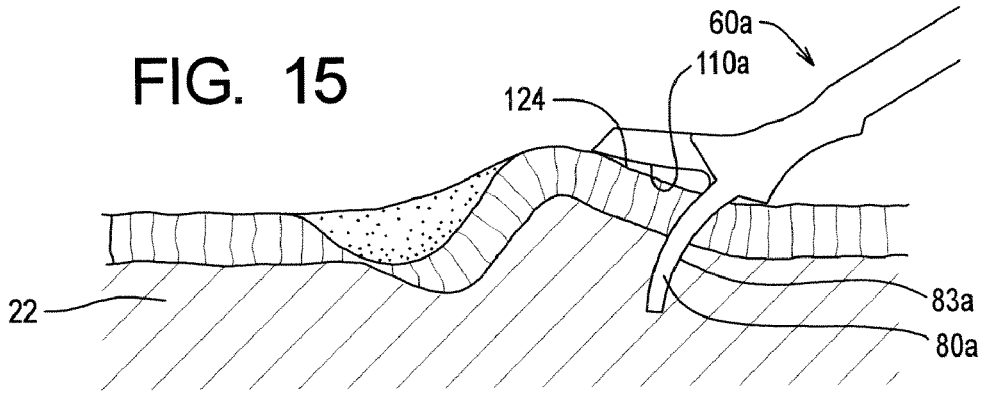
Figure 16:
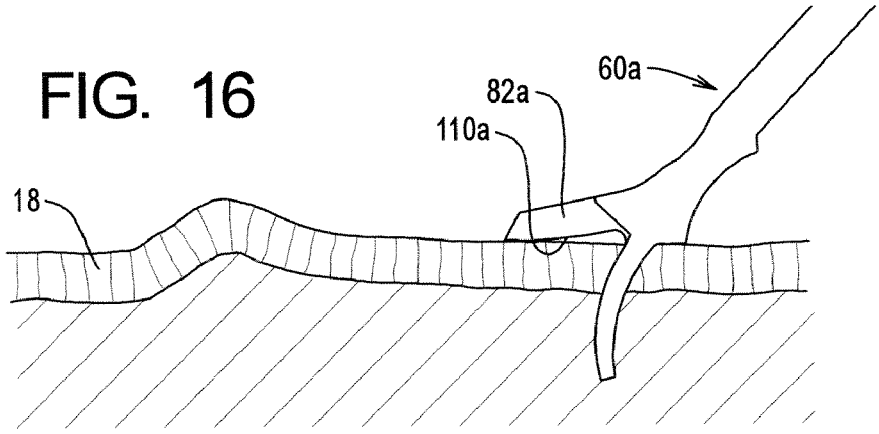

Reference is now made to FIGS. 14-16 where the tool **60*a*** is schematically shown in operation.

In a similar manner as shown in FIGS. 9-11, a crater on a green has occurred and the golfer must repair it. In general, the forward portion of the crater and adjacent lateral portions have the built-up region as described in the beginning of this text. The tool **60*a* is adapted to reposition the sod layer 18 and have it remain substantially intact whereby the ground layer 22** is shifted back to an approximate original location in the central area of the crater.

As shown in FIG. 14, the earth engaging region 80 has just begun to enter the upper portion of the sod layer 18. It is desirable to engage the sod layer 18 at the undisturbed region just outside of the crater mound 120 at a location indicated at 122. The orientation of the tool 60*a* should be such that the front portion of the sod repositioning surface 110*a* is above in the horizontal plane with respects to the base portion of the surface 110*a*.

Now referring to FIG. 15, the earth engaging region 80*a* is partially engaged into the upper sod layer 18 and the forward portion of the mound 124 is beginning to be biased rearwardly and downwardly. In general, the lower surface 83*a* of the earth engaging region 80*a* is adapted to reposition the depth limiting feature 82*a* in the rearward direction as the sod repositioning surface 110*a* moves downwardly and has a rolling effect to gradually engage the turf as the tool 60*a* rotates in a counterclockwise manner as shown in FIG. 15. Now referring to FIG. 16, it can be seen how the earth engaging surface 110*a* has repositioned the upper sod layer 18 downwardly and rearwardly. Further, the ground layer 22 is repositioned toward the center of the crater region. This process can occur around the various forward and lateral regions of the crater to obtain a very desirable putting surface.

Figure 13A:
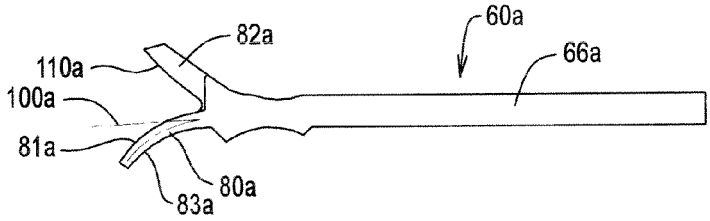
FIG. 13A is a side view of the second embodiment of the tool.
Figure 17:
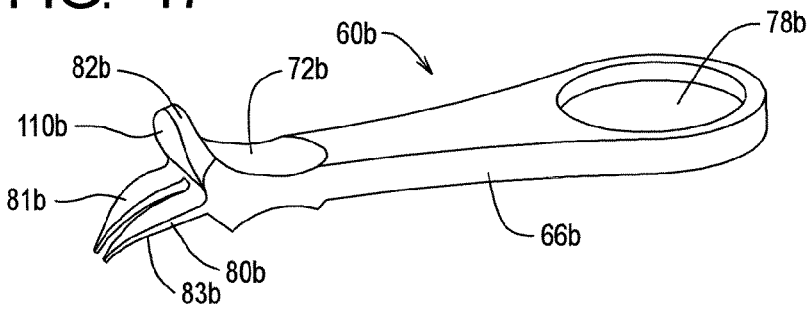
FIG. 17 shows a third embodiment of a tool that is adapted to repair craters.
Figure 18:
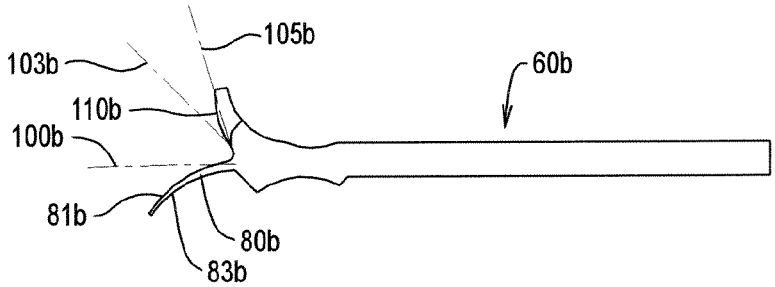
FIG. 18 is a side view of the third embodiment.
Figure 19:
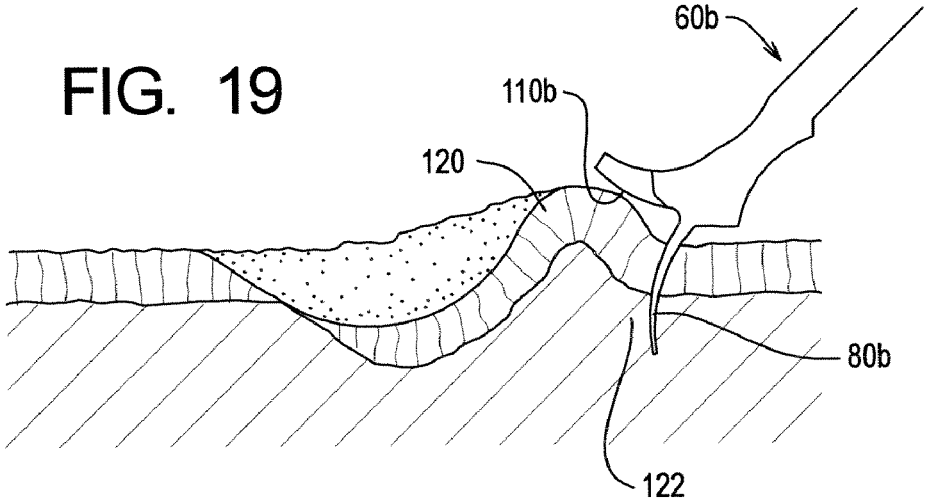
FIGS. 19-21 are progressive views of a method of repairing a crater with the embodiment as shown in FIG. 17.

The FIGS. 17-21 show another embodiment, where as seen in FIGS. 17-18, the earth engaging region 80*b* comprises an upper surface 81*b* and a lower surface 83*b*. The earth engaging axis 100*b* as shown in FIG. 18 is similar to that shown in FIG. 13A. FIG. 18 further shows the earth engaging surface 110*b* that is slightly arced in a longitudinally rearward direction at the tip region. The sod engagement direction changes from an initial direction indicated that 103*b* to a final direction indicated at 105*b*. As shown in FIG. 19, the earth engaging region 80*b* is inserted to the sod layer 18. As with the previous examples, in one form it is desirable to engage the sod layer 18 at the undisturbed region just outside of the crater mound 120 at a location indicated at 122. The orientation of the tool 60*b* should be such that the front portion of the earth engaging surface 110*b* is above in the horizontal plane with respect to the base portion of the surface 110*b*.

Figure 20:
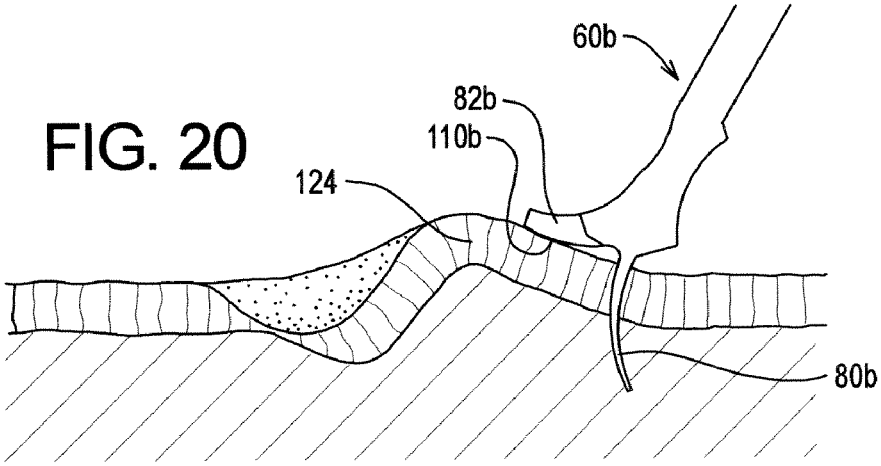
Figure 21:
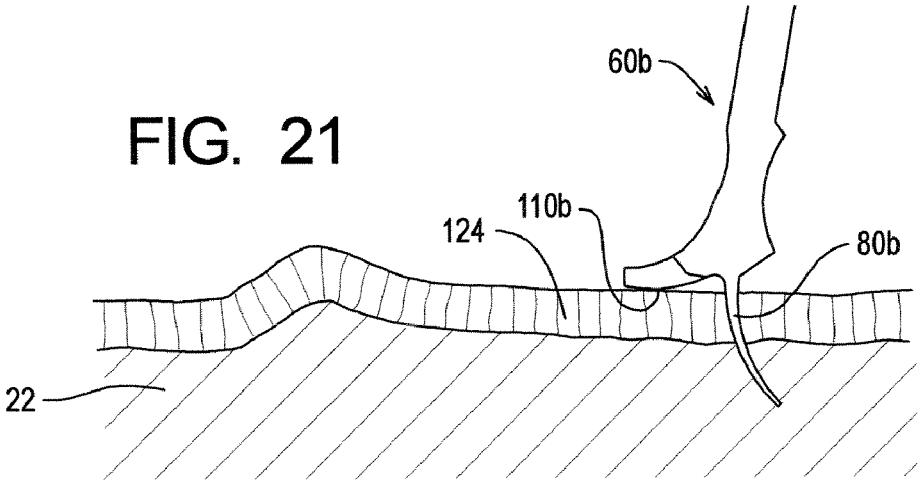

FIG. 20 shows the earth engaging region 80*b* partially engaged into the upper sod layer 18 and the forward portion of the mound 124 is beginning to be biased rearwardly and downwardly. In general, the lower surface 83*b* of the earth engaging region 80*b* repositions the depth limiting feature 82*b* in the rearward direction as the sod repositioning surface 110*b* moves downwardly and has a rolling effect to gradually engage the turf as the tool 60*b* rotates in a counterclockwise manner as shown in the Fig. Now referring to FIG. 21, it can be seen how the sod repositioning surface 110*b* has repositioned the upper sod layer 18 downwardly and rearwardly. Further, the ground layer 22 is repositioned toward the center of the crater region. This process can occur around the various forward and lateral regions of the crater to obtain a substantially flat putting surface. It should be noted that in this figure as well as the previous related FIGS. 11 and 16, the tool can be repositioned at alternative lateral and rearward positions around the crater where these figures can represent the various alternative cross-sectional views to show the progressive flattening of the crater.

Figure 22:
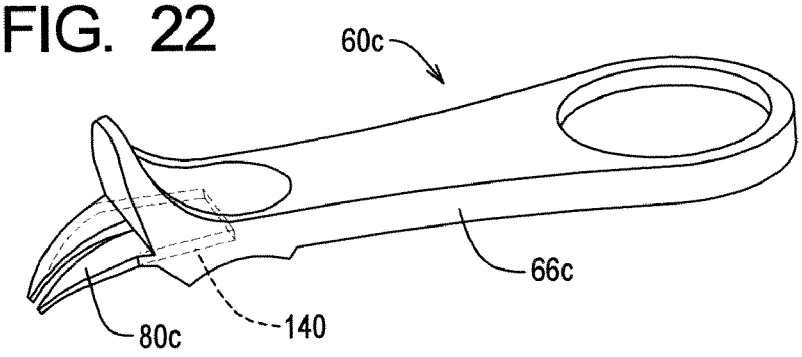
FIG. 22 shows a fourth embodiment of a tool that is adapted to repair craters on a golf green.
Figure 23:
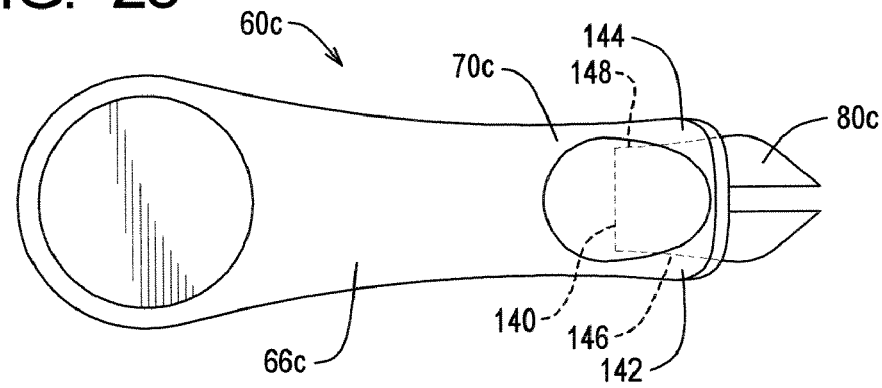
FIG. 23 is a top view of the fourth embodiment of the tool.

FIGS. 22 and 23 show another embodiment of the tool 60*c* where the earth engaging region 80*c* has an insert region 140 that is adapted to be received in a cavity of the handle region 66*c*. This embodiment allows for a metallic type insert that can be stamped out and have an earth engaging region 80*c* that is similar to that as shown in FIG. 2 or have the geometry of one of the previous figures whereby the insert region is adapted to rigidly hold the earth engaging region 80*c* with respects to the handle region 66*c*.

As shown in FIG. 23, the handle region 66C has lateral extensions 142 and 144 that adapted to be positioned along the lateral edges 146 and 148 of the insert region 140. One form of manufacture is to heat the insert region 140 (if it were metallic) and insert this region into the forward portion 70*c* of the handle 66*c*. In one form a partial cavity can be located in the forward region 70*c* whereby the insert region 140 has an interference fit therein.

Figure 24:
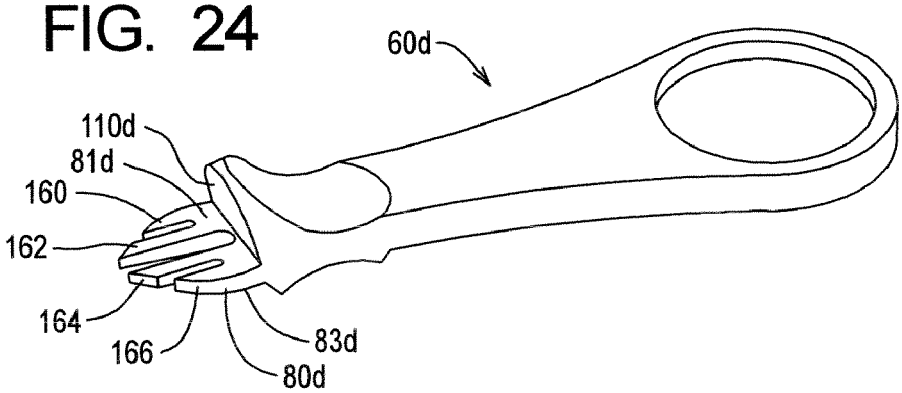
FIG. 24 is isometric view of a fifth embodiment.

FIG. 24 shows another embodiment where the tool 60*d* has a earth engaging region 80*d* that comprises a plurality of prongs 160, 162, 164 and 166. Of course any number of prongs can be employed and additional prongs can aid in the prevention of cutting rhizomes and stolons. The prongs and general comprises an upper surface 81*d* and a lower surface 81*d*. The lower surface 81*d* is adapted to engage the earth and give the biasing force as described above so the sod repositioning surface 110*d* can bias the sod in a similar manner as previously described.

Figure 25:
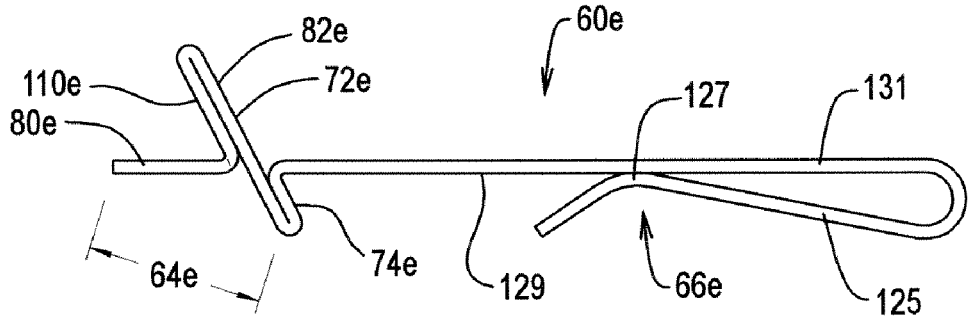
FIG. 25 shows a side view of the sixth embodiment of a green fix tool.
Figure 26:
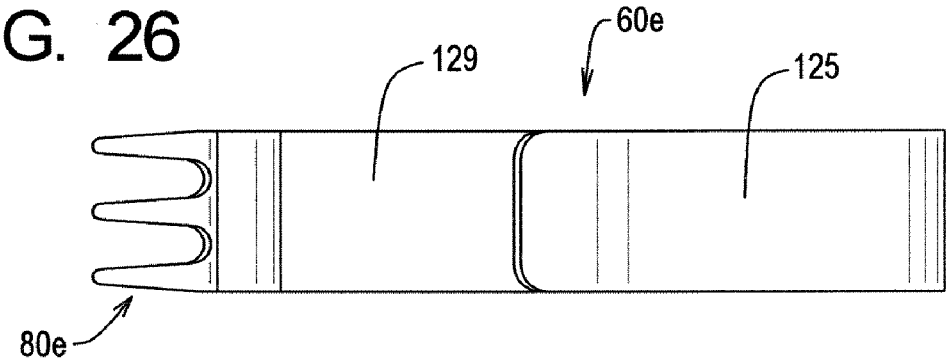
FIG. 26 shows a top view of the sixth embodiment.

Now referring to FIG. 25, there is shown yet another embodiment whereby operating region 64*e* and the handle region/grasping region 66*e* are essentially formed from a unitary piece of material, which in one preferred form is bent from a piece of metal to form the various regions and surfaces. The depth limiting feature 82*e* is provided with the forward earth engaging surface 110*e* that is adapted to engage the various raised perimeter portions of the green in a manner as thoroughly described above. The earth penetrating region 80*e* is comprised of one or more prongs that are adapted to engage the upper turf mat of the green with minimal displacement of the root structure. The depth limiting feature 82*e* further has a thumb engagement surface 72*e* which is adapted to allow the user to provide the downward and horizontal thrusting action towards the center axis (center cavity region) of the ball crater in the green. Further, an index finger engagement surface 74*e* can be provided in the lower transverse portion of the tool 60*e*.

It should be further noted that in the handle region 62*e*, the metal can be bent in a manner to form a hooked portion 125 having a forward portion 127 which is preferably in close engagement to the lower transverse surface 129. The hooked portion 125 can have a springlike effect with respect to the grasping handle 131 where the forward portion 127 allows a clamping-like action so the green fix repair tool 60*e* can be attached to various straps or loops on a golfer's attire or his gear such as his golf bag.

Figure 27:
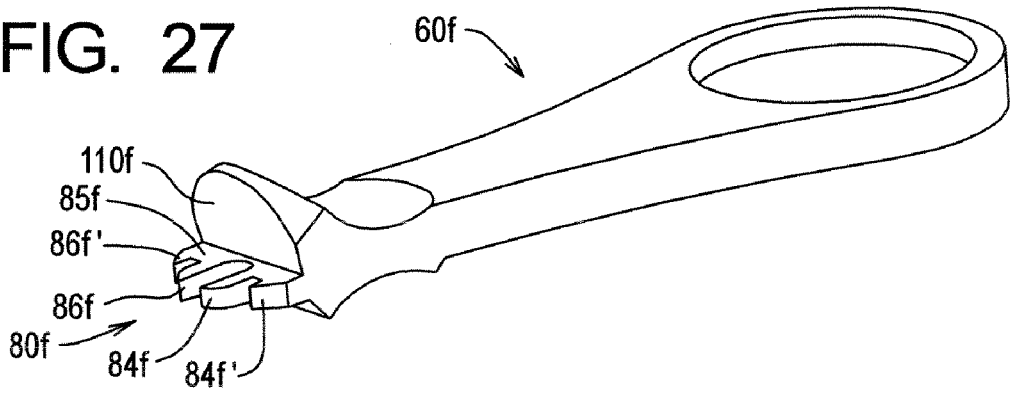
FIG. 27 shows another embodiment.

As shown in FIG. 27, there is another embodiment where the earth penetrating region 80*f* has a plurality of prongs 84*f* and 86*f* as well as the lateral prongs 84*f*' and 86*f*'. In general, the length of these prongs from the base region 85*f* is much shorter where the primary function of the tool is for repositioning the soil by the earth engaging surface 110*f*. The length of the prongs can be down to ⅛ of an inch in an extreme form where the primary purpose of the prongs is to maintain the position of the tool 60*f* against the perimeter region of the crater.

It can therefore be appreciated that while the present invention is illustrated by the description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative concepts shown and described. Accordingly, departures may be made from such details without departing from the spirit or scope of applicants' general concept.

The invention claimed is:

1. A method of repairing an indentation, comprising a perimeter region, a center region, a surrounding green planar region, of a golf green comprising the steps of:

a) positioning a golf green repair tool comprising a prong portion, and an earth engaging surface, to the perimeter region of the indentation, b) aligning the prong portion of the golf green repair tool at an angle towards the center region of the indentation, c) penetrating the perimeter region of the indentation with the prong portion towards the center region of the indentation and engaging the earth engaging surface into a portion of the perimeter region substantially spanning sufficient surface area between lateral edge locations of the earth engaging surface to bias the perimeter region of the indention towards the center region of the indentation, d) linearly thrusting the golf green repair tool towards the center region of the indentation whereby the earth engaging surface is slanted forward toward the direction of thrust as angularly measured from the earth engaging surface forward to a line parallel to the direction of thrust, and the earth engaging surface repositions the perimeter portion of the indentation downwardly and radially inwardly of the indentation to an upper surface orientation closer to the surrounding planar green region.

2. The method as recited in claim 1 further comprising a step whereby the golf repair tool is repositioned to an upper ridge location around the perimeter region of the indentation and the prong region is linearly thrust toward the center region indentation and an additional perimeter raised portion of the indentation is repositioned downwardly and radially inwardly.

3. The method as recited in claim 1 where the golf green repair tool comprises a handle region comprising a rearward portion that is operatively configured to display an insignia.

4. The method as recited in claim 1 where the angle of the earth engagement surface with respect to an operating axis of the prong portion is less than 90 degrees.

5. The method as recited in claim 1 where the prong portion is comprised of first and second prongs that each comprise a lower surface and exterior edges having minimal sharp contours to prevent incising root structures of the perimeter region of the crater.

* * * * *